US010350622B2

(12) United States Patent
Schwab

(10) Patent No.: US 10,350,622 B2
(45) Date of Patent: Jul. 16, 2019

(54) TEMPERATURE CONTROLLED COATING SYSTEM FOR COATING OBJECTS

(71) Applicant: EISENMANN SE, Boeblingen (DE)

(72) Inventor: Stephan Schwab, Waldenbuch (DE)

(73) Assignee: EISENMANN SE, Boeblingen (DE)

( * ) Notice: Subject to any disclaimer, the term of this patent is extended or adjusted under 35 U.S.C. 154(b) by 0 days.

(21) Appl. No.: 14/711,894

(22) Filed: May 14, 2015

(65) Prior Publication Data

US 2015/0328654 A1 Nov. 19, 2015

(30) Foreign Application Priority Data

May 14, 2014 (DE) ..... 10 2014 007 048

(51) Int. Cl.

| | |
|---|---|
| ***B05B 1/24*** | (2006.01) |
| ***B05B 12/10*** | (2006.01) |
| ***B05B 9/01*** | (2006.01) |
| ***B05C 9/14*** | (2006.01) |
| ***B05C 11/10*** | (2006.01) |
| ***B05C 17/005*** | (2006.01) |
| *B05B 9/00* | (2006.01) |
| *B05B 15/555* | (2018.01) |

(52) U.S. Cl.

CPC ..... *B05B 12/10* (2013.01); *B05B 1/24* (2013.01); *B05C 9/14* (2013.01); *B05C 11/1042* (2013.01); *B05C 17/00533* (2013.01); *B05B 9/002* (2013.01); *B05B 9/01* (2013.01); *B05B 15/555* (2018.02); *B05C 17/00546* (2013.01)

(58) Field of Classification Search

CPC ..... B05C 5/001; B05C 9/14; B05C 11/1007; B05C 9/10; B05C 17/00546; B05B 7/208; B05B 7/22; B05B 7/1673; B05B 7/166; B05B 9/002; F24H 1/121

See application file for complete search history.

(56) References Cited

U.S. PATENT DOCUMENTS 3,733,059 A * 5/1973 Pettit ..... B29C 47/92 264/40.6
3,991,708 A * 11/1976 Huebschmann ..... B05C 1/0813 118/202
4,383,645 A * 5/1983 Figiel ..... B05B 7/1686 239/128
4,478,669 A * 10/1984 Zeller ..... B23K 13/00 156/379.7
4,501,952 A * 2/1985 Lehrke ..... B05B 7/22 165/156

(Continued)

FOREIGN PATENT DOCUMENTS

DE 39 36 499 A1 5/1991
DE 100 31 852 A1 1/2002

(Continued)

*Primary Examiner* — Karl Kurple

(74) *Attorney, Agent, or Firm* — Schroeder Intellectual Property Law Group, LLC

(57) ABSTRACT

A coating system for coating objects comprises an application device and a supply system, by means of which at least one liquid material can be fed to the application device via a flow path. A temperature control arrangement is present, by which the temperature of the at least one liquid material can be controlled in the flow path and/or the application device in at least one temperature control region.

11 Claims, 2 Drawing Sheets

(56) References Cited

U.S. PATENT DOCUMENTS 4,527,717 A * 7/1985 Emoto ..... B22D 37/00 222/146.5
4,644,140 A * 2/1987 Hillinger ..... B05B 1/24 219/421
4,667,852 A * 5/1987 Siemann ..... B05C 5/001 222/146.1
4,862,951 A * 9/1989 Muller ..... F28D 7/024 123/557
4,875,845 A * 10/1989 Hara ..... B29C 45/20 264/328.15
4,998,502 A 3/1991 Schucker
5,050,533 A 9/1991 Zaber
5,171,613 A 12/1992 Bok et al.
5,535,919 A * 7/1996 Ganzer ..... B05C 5/001 222/1
5,747,102 A * 5/1998 Smith ..... B05C 5/001 222/1
6,202,892 B1 * 3/2001 Lasko ..... B05C 17/0053 222/108
6,223,950 B1 * 5/2001 Lasko ..... B05C 17/0053 219/426
6,230,936 B1 * 5/2001 Lasko ..... B05C 17/0053 219/426
6,253,957 B1 * 7/2001 Messerly ..... B05C 5/001 222/1
6,318,599 B2 * 11/2001 Estelle ..... B05C 5/001 222/146.5
6,874,662 B2 * 4/2005 Kim ..... G02F 1/1341 222/146.5
7,178,742 B2 2/2007 Mellentine
9,427,768 B2 * 8/2016 Varga ..... B05C 11/1034
2002/0129767 A1 9/2002 Czerwonka
2004/0256501 A1 12/2004 Mellentine et al.
2005/0092736 A1 5/2005 Raterman et al.
2005/0230423 A1 * 10/2005 Riney ..... B05C 5/001 222/146.2
2005/0236430 A1 10/2005 Clark et al.
2006/0233960 A1 * 10/2006 Warren ..... B05B 7/166 427/421.1
2007/0001332 A1 * 1/2007 Lau ..... B29C 45/78 264/40.6
2008/0166490 A1 7/2008 Hogan et al.
2010/0178433 A1 * 7/2010 Wang ..... B05C 9/10 427/545
2013/0032090 A1 * 2/2013 Yano ..... B05C 5/001 118/706
2013/0105078 A1 * 5/2013 Dawson ..... E01C 23/082 156/297
2013/0284833 A1 * 10/2013 Fritz ..... B05B 1/02 239/690
2014/0117049 A1 * 5/2014 Varga ..... B05C 11/1034 222/145.6
2016/0016192 A1 * 1/2016 Yang ..... H01L 33/005 438/29

FOREIGN PATENT DOCUMENTS

DE 10 2004 021 223 A1 12/2004
DE 10 2010 019 612 A1 11/2011
DE 10 2012 016 360 A1 5/2014
WO 8800675 A1 1/1988
WO 9626013 A1 8/1996

* cited by examiner

TEMPERATURE CONTROLLED COATING SYSTEM FOR COATING OBJECTS

RELATED APPLICATIONS

This application claims priority to German Application No. 10 2014 007 048.4 filed May 14, 2014, the contents of which is incorporated herein by reference.

TECHNICAL FIELD

The invention relates to a coating system for coating objects, with a) an application device;

b) a supply system, by means of which the application device can be supplied with at least one liquid material via a flow path.

BACKGROUND OF THE INVENTION

In coating systems of the type stated at the beginning that are known from the market, the application device, which can be a high-speed rotating atomizer or a spray gun in paint processes, for example, is supplied with liquid materials. On the one hand, these can be liquid coating materials, in particular paints, which are applied to an object to be coated.

On the other hand, solvents, flushing agents or release agents also flow through the flow path to the application device and are also delivered by this if applicable. For example, in the case of a material change, the conduits and lines carrying the material must be cleaned of the paint used previously, to which end a flushing agent is conveyed through the relevant conduits and lines. For instance, in the case of a paint shop, a change device is used for coating materials for such a material change, i.e. a colour change device, if it occurs frequently in normal operation that for coating an object a paint is to be used other than the paint with which a preceding object was painted.

To keep paint losses and the amounts of flushing agent required to a minimum, so-called pigging technology is often used, in which the coating materials or the flushing agent is pushed through the conduits and lines with the aid of pigs. In this case the pig is moved back and forth between two pigging stations, one of which is arranged close to the application device and the other close to the change device.

In addition to paints, other coating materials can be applied with different application devices, for example preservatives such as waxes, individual components of multi-component adhesives or if applicable even highly viscous substances such as sealants.

Without further measures the liquid materials are conducted through the flow path at a temperature that corresponds to the ambient temperature or the temperature at which the materials were introduced into the line system. Paints in particular, but also flushing agents, are normally kept in a paint supply room in containers and are brought there to a set temperature, which should as far as possible exist also upon delivery of the material by the application device, before the materials are introduced into the line system. To this end the material is heated or cooled depending on its starting temperature and the desired target temperature.

On its path through the line system to the application device, however, the temperature of the material can change under the influence of the ambient temperature. Moreover, a usage temperature of the materials that is higher or lower than the ambient temperature can lead to positive effects in different application or operating processes. Thus most normal flushing agents can take up more contaminants at higher temperatures than is possible at a comparatively lower temperature. An increased or reduced temperature compared with the ambient temperature can be desirable for the coating materials too.

SUMMARY OF THE INVENTION

An object of the invention therefore consists in creating a coating system of the type stated at the beginning that takes account of these considerations.

This object may be achieved in the coating system of the type named at the beginning in that c) a temperature control arrangement is present, by which the at least one liquid material in the flow path and/or the application device can be temperature-controlled in at least one temperature control region.

According to the invention, therefore, liquid materials, be it a liquid coating material or flushing agent or another liquid material, can be brought to a desired target temperature inside the flow path, preferably on its way to the application device, or in the application device itself. Temperature control can mean both heating and cooling.

In this way the temperature of the material to be applied can be set accurately. For example, a solid-colour paint could have optimal application properties in a certain application process at a material temperature of 20° C., while a metallic paint can be processed optimally at a material temperature of 22° C.

Due to the temperature control arrangement, it is even possible to react quickly in the case of a colour change to the changed temperature requirements and to set the desired material temperature required for an optimum coating result.

It has now become established that coating material that is not applied and is still located in the lines to the application device is returned to its material source to minimise the paint losses. In this case, too, materials and in particular flushing agent flows through the flow path, which agent can then move, however, in the direction away from the application device. In this case it is advantageous if the material returned to the supply lines is brought roughly to the temperature of the material in the material source. The temperature of the material can thus be controlled such that it flows back into the material source again at its starting temperature.

In most cases, heating of the liquid material will be necessary, as starting out from a starting temperature this cools somewhat again on the flow path to the application device. It is especially favourable, therefore, if a temperature control unit with a temperature control element is arranged in the at least one temperature control region. Reliable heating or cooling of the material can thus be ensured.

In order to monitor the temperature of the liquid material in a manner that can be tracked, the temperature control unit preferably comprises at least one temperature sensor, which is arranged upstream or downstream of the temperature control element.

It is particularly effective if a temperature control region is arranged on or in the application device. The temperature can thus be set and monitored if applicable shortly before the moment of delivery by the application device.

If the application device comprises an outlet end line, it is favourable if the temperature control element of the temperature control unit is arranged on this.

Alternatively or in addition, a temperature control element can be arranged on a section of a supply line for coating material that runs through the application device.

It can also be advantageous if at least one temperature control region is arranged on or in the flow path.

With respect to a change of material addressed above, it is favourable if the flow path comprises a valve device, which is fed with liquid material from several material sources and on or in which at least one temperature control region is arranged. In this case the temperature of material can be set directly on entry into the flow path.

It can be advantageous if the flow path comprises at least one piston dosing unit, on or in which a temperature control region is arranged. Material can be conveyed in an effective manner to the application device by means of a piston dosing unit. A piston dosing unit normally has a working chamber with a cross section larger than supply or removal lines. It is therefore favourable if the temperature can be set there.

It is also advantageous if a) a temperature control region is arranged on or in a supply line between the piston dosing unit and the application device;

and/or b) a temperature control region is arranged on or in a feeder line between the piston dosing unit and a material source.

For effective cleaning of the application device this is preferably connected to a flushing device, by means of which the application device can be supplied with flushing agent via a flushing agent line. To control the temperature of the flushing agent and achieve a better flushing effect thereby, it is favourable in this case if a) a temperature control region is arranged on or in the flushing device;

and/or b) a temperature control region is arranged on or in the flushing agent line.

With regard to a heating of the material, it is advantageous if the temperature control unit is a heating unit and the temperature control element is a heating element.

The heating unit is then preferably an inductive heating unit, which comprises a heating coil as heating element, which coil surrounds a section of the flow path and/or the application device, so that liquid material can flow through the heating coil.

Alternatively or in addition, the temperature control unit can comprise a heat exchanger unit or a Peltier element as temperature control element.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Embodiments of the invention are explained in greater detail below with reference to the drawings.

DETAILED DESCRIPTION OF THE PRESENT INVENTION

Figure 1:
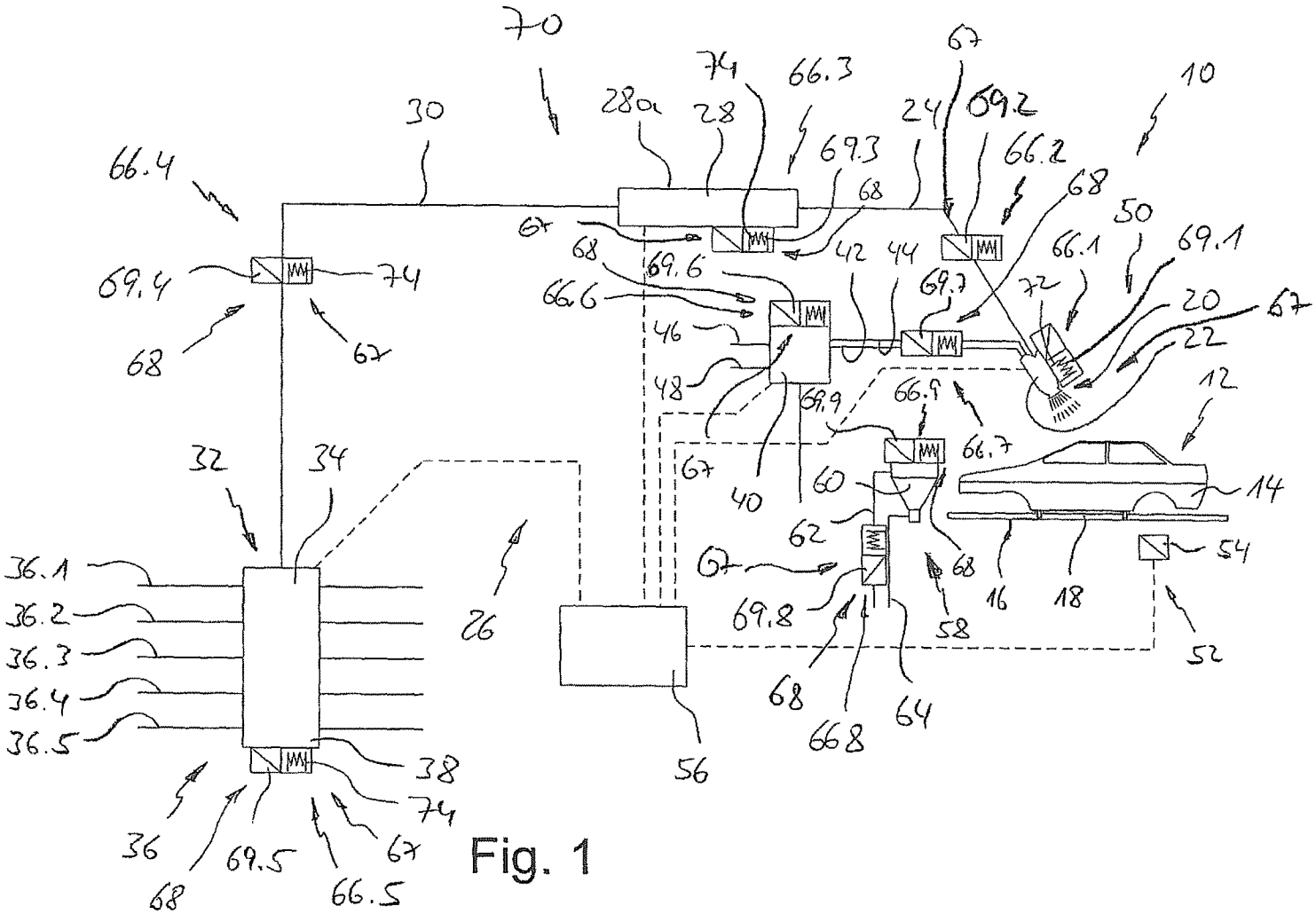
FIG. 1 shows schematically the layout of a coating system, in which liquid media can be heated by means of a heating system, which comprises one or more heating units.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In FIG. 1, 10 designates a coating system as a whole for the application of coating materials to objects 12, which are illustrated here as vehicle bodies 14. An object 12 is attached to a supporting structure 16, which in the case of vehicle bodies 14 is formed as a so-called skid 18, for example.

The coating system comprises an application device 20. In the present case a coating system 10 for paints is described by way of example. In this case the application device 20 can be a spray gun or a high-speed rotating atomizer 22, for example, as is known in itself.

The application device 20 is connected to a supply line 24 of a supply system designated as a whole by 26, wherein the supply line 24 leads to a piston dosing unit 28, shown only very schematically, of the supply system 26, as is known in itself.

The piston dosing unit 28 is connected for its part via a feeder line 30 to a valve device 32, which is formed in the present embodiment as a change device 34 for coating materials and is fed for its part from several material sources 36 with fluid material, as is also known in itself.

In the present embodiment, there are five material sources 36 in the form of ring pipes 36.1 to 36.5, but fewer or even considerably more such ring pipes can be present, the number of which can be 50 or more. The fluid materials offered by the ring pipes 36.1 to 36.5 can be compressed air and flushing agents as well as different coating materials, in particular different paints. In the application of paints the change device 34 is thus a colour change device 38.

The application device 20 can also be supplied from a flushing device in the form of a flushing block 40 with compressed air via a separate compressed air line 42 and flushing agent via a separate flushing agent line 44. For this purpose the flushing block 40 optionally connects the compressed air line 42 to a compressed air source 46 and/or the flushing agent line 44 to a flushing agent source 48, so that the application device 20 can be supplied optionally with compressed air or flushing agent or both.

The supply line 24, the piston dosing unit 28, the feeder line 30 and the valve device 32 together form a flow path for materials from the material sources 36 to the application device 20.

The coating of the objects 12 takes place in a coating zone 50, which is delimited, for example, by a coating booth that is not specifically shown. The operating atmosphere in this coating zone 50 is conditioned in a known manner and is monitored in particular with respect to the humidity and the solvent concentration present as well as the temperature. For this purpose a sensor device 52 can be present, as shown in FIG. 1, which monitors the desired parameters and of which one sensor 54 is shown by way of example.

As a variation, the operating atmosphere in the coating zone 52 can also be detected on the basis of data determined in preceding conditioning processes for air that is to be fed to the coating zone. Normally conditioned air flows from a plenum chamber from top to bottom through the coating zone 50 and takes up overspray in the process, which is removed from the coating zone 50 in this way.

The application device 20, the piston dosing unit 28, the valve device 32 and the flushing block 40 are activated by means of a control unit 56, which is shown by dashed lines in FIG. 1. The sensor device 52 also communicates with the control unit 56, which, depending on the sensor information received, controls devices that are not shown in themselves, by which the operating atmosphere in the coating zone 50 can be set.

During the operating period, overspray settles on the outer surface of the application device 20, for which reason this must be cleaned at regular intervals. To do this, a cleaning device 58 is present with a receptacle 60, into the interior of which the application device 20 can be guided and immersed, so to speak. Flushing agent can be blown into the interior of the receptacle 60 via a flushing agent line 62 and spray nozzles, which are not shown specifically here, and this wets the application device 20 and rinses away any contaminants present. The flushing agent laden with contaminants flows away downwards in the receptacle 60, where it is removed via a drain line 62. In the present embodiment the receptacle 60 is formed as a whole in the shape of a funnel.

The coating system 10 now comprises one or more temperature control regions 66 on or in the flow path 24, 28, 30, 32, in which fluid media in the flow path 24, 28, 30, 32 and/or the application device 20 can be heated or cooled. In particular, liquid materials in the flow path 24, 28, 30, 32 of the coating system 10 can be heated or cooled in the temperature control region or regions 66. To this end a temperature control unit 67 with a temperature control element 68 is present in each temperature control region 66.

Depending on the application and requirement, a temperature control can be desirable in principle for all media carried in the lines, thus for coating materials, in particular paints, and solvents, flushing agents, release agents and also air, which are required in the coating of objects.

In the present embodiment, a heating unit 69 of a temperature control arrangement 70 is present as a temperature control unit 67. A temperature control region 66 is consequently a heating region in this case.

In summary, FIGS. 1 and 2 show a plurality of temperature control regions 66.1 to 66.9. However, as an alternative to all temperature control regions 66 shown, the coating system 10 can also have only a single one of the temperature control regions 66 shown or some of the temperature control regions 66 shown. The temperature control regions 66 shown and explained below can thus be present as alternatives or complementary to one another.

The temperature control units 67 can also have a respective temperature sensor 72 to detect the temperature of the medium. For the sake of clarity, a temperature sensor 72 is only shown in the FIGS. 2A, 2B and 2C. One or more control loops can thus be formed in conjunction with the controller 56, by means of which loops the actual temperature of a material can be adjusted to a target temperature. All temperature sensors 72 present can be read via the controller 56, so that in ongoing operation with several temperature control units 67 along the flow path 24, 28, 30, 32 a temperature profile of the liquid material can be produced between material source 36 and the outlet of the application device 20.

The heating units 69 are designed as inductive heating units, the temperature control element 68 of which is a heating element 74 in the form of a heating coil in each case, which is likewise designated with the reference sign 74 below and which surrounds the line carrying the respective material or a region carrying a respective material, i.e. generally a section of the line system 24, 28, 30, 32, 36 and/or the application device 20, so that the heating coil 74 can be passed by liquid material. Only some of the heating coils 74 of the individual heating units 69 are provided with a reference sign. In the case of modifications not specifically shown, the respective heating element of a heating unit 69 can also be formed differently. For example, a radiation source is also considered.

Alternatively or in addition, temperature control elements 68 can also be present that can basically heat and cool. For this purpose a temperature control element 68 can be a heat exchanger element or in particular a Peltier element, for example, the technology of which is known. Even pure cooling elements can be present.

Depending on the nature and manner and arrangement of the temperature control elements 68 in the flow path 24, 28, 30, 32, the material can the material to be temperature-controlled can be adjusted to the desired target temperature in a cascade-like manner on its way to the application device.

The energy supply of the individual heating units is not specifically shown for the sake of clarity. The heating units 69 respectively present are likewise coordinated by the control unit 56.

Figure 2A:
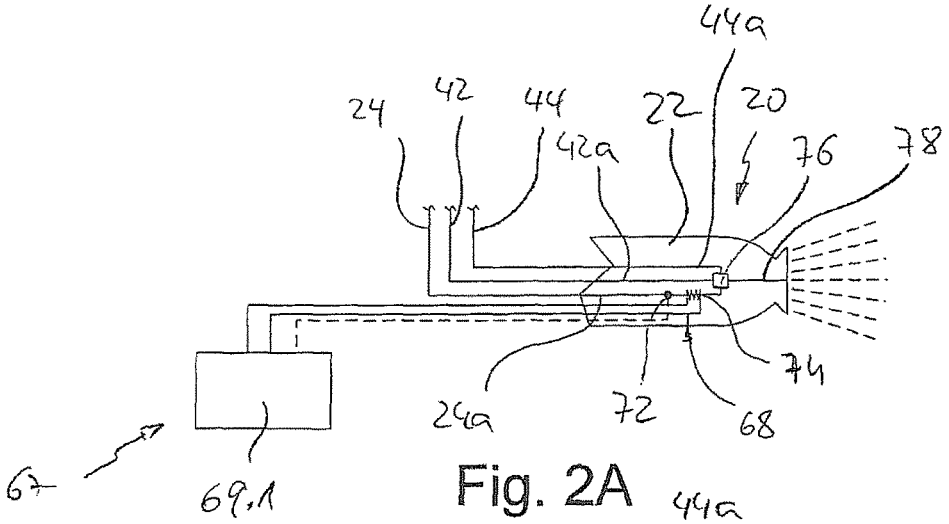
FIGS. 2A, 2B and 2C show schematically three alternative arrangements for detecting the temperature of a medium in an application device.
Figure 2B:
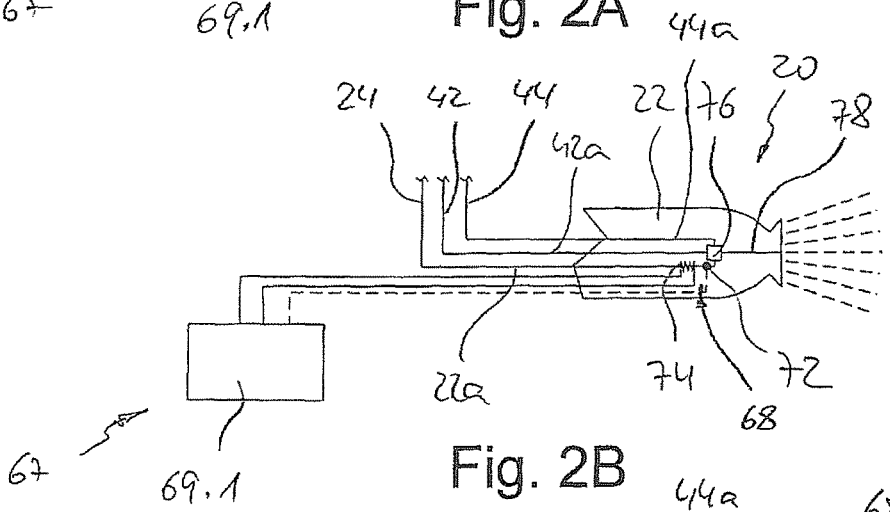
Figure 2C:
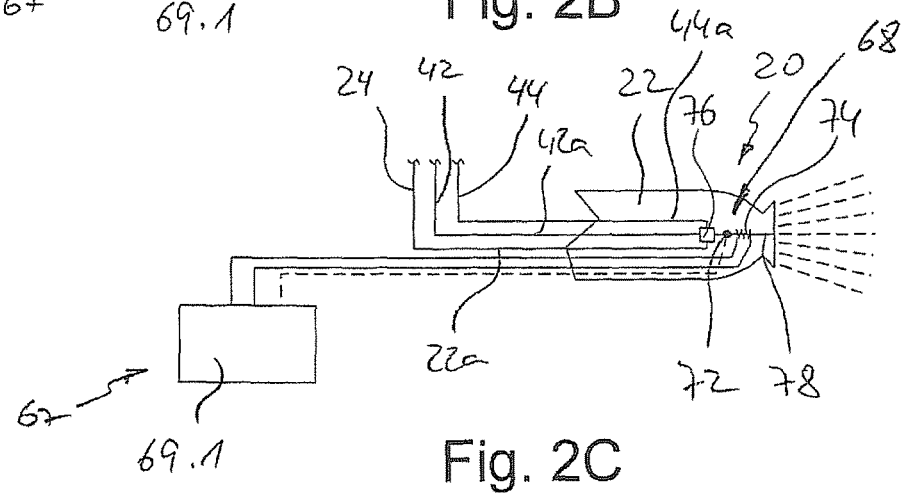

A first temperature control region 66.1 is now defined on or in the application device 20, so that media to be delivered via the application device 20 can be heated to the desired temperature shortly before delivery. In FIGS. 2A to 2C the application device 20 is shown in greater detail. As is to be recognised there, the supply line 24 of the supply system 26 and the compressed air and flushing agent line 42 and 44 coming from the flushing block 40 run together with partial sections 24*a*, 42*a* and 44*a* inside the application device 20 in a changeover valve 76, from which one outlet end line 78 leads to the outlet of the application device 20.

In the variant according to FIG. 2A, the heating coil 74 of the heating unit 69.1 is arranged on the supply line section 24*a* close to the changeover valve 76. The temperature sensor 72 is positioned there upstream of the heating coil 74, so that the temperature of the approaching medium can be detected.

In the variant according to FIG. 2B, the temperature sensor 72 is arranged downstream of the heating coil 74, on the other hand, so that the temperature of the just heated medium can be detected.

In the variant according to FIG. 2C, the heating coil 74 is located on the outlet end line 78, so that each medium fed through the lines 24, 42 or 44 can be heated. The temperature sensor 72 is once again arranged there by way of example upstream of the heating coil 74, but can also be provided downstream of it.

In a modification, a temperature sensor 72 can be arranged both upstream and downstream of the heating element, in this case the heating coil 74. Thus both the temperature of material flowing to the heating unit 69 and of material flowing away from the heating unit 69 can be detected.

The assigned temperature sensor 72 can be arranged accordingly upstream or downstream of the respective heating coil 74 for all heating units 69, wherein the arrangement downstream is preferred, as the temperature attained by the medium can be detected directly in this way.

A further temperature control region 66.2 with heating unit 69.2 is present on or in the supply line 24. A temperature control region 66.3 is on or in the piston dosing unit 28 and a further temperature control region 66.4 on or in the feeder line 30 between the valve device 32 and the piston dosing unit 28. In the case of the piston dosing unit 28, the heating coil 74 there surrounds the piston chamber, designated 28*a*, of the piston dosing unit 28.

A temperature control region 66.5 shown on or in the valve device 32 shows a heating unit 69.5, which denotes one or more heating units 69 by way of example, with which material from the material sources 36 can be heated directly on entry to the valve device 32.

A temperature control region 66.6 shown on or in the flushing block 40 shows a heating unit 69.6, which denotes one or more heating units 69 by way of example, with which material from the compressed air source 46 and the flushing agent source 48 can be heated directly on entry to the flushing block 40. Alternatively or in addition, a temperature control region 66.7 is present on or in the compressed air line 42 and/or flushing agent line 44 respectively exiting the flushing block 40.

A further temperature control region 66.8 is provided on the flushing agent line 62 of the cleaning device 58, so that cleaning agent applied there can be heated. Alternatively or in addition, a temperature control region 66.9 is defined on the receptacle 60.

Due to the possibility of heating the media in ongoing operation of the coating system 10 in individual temperature control regions 66, resources can be saved among other things. This applies above all in respect of flushing agents and solvents, which can be heated when flowing through the assigned lines, as these can take up more contaminants at higher temperatures than at comparatively lower temperatures. However, even in the case of coating materials, the processing temperature of the materials has a not inconsiderable influence on the coating result, so that here different temperature adaptations can be made individually for various coating materials.

The temperature of air or any other gaseous medium can also be controlled in the flow path 24, 28, 30, 32 or the application device 20 using the temperature control units 67 if this is necessary or desirable.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A coating system for coating objects comprising:

a) an application device;

b) a supply system which feeds at least one liquid material to the application device via a flow path comprising a valve device and at least one piston dosing unit; wherein the application device, the at least one piston dosing unit, and the valve device are activated by a control unit, wherein c) a first temperature control unit on or in the valve device which controls a temperature of the at least one liquid material as the at least one liquid materiel enters the valve device from a materiel source, and a second temperature control unit on or in the at least one piston dosing unit to control the temperature of the at least one liquid material in the at least one piston dosing unit; wherein d) each temperature control unit is a heating unit and the comprises a temperature control element which is a heating element, each heating unit being an inductive heating unit and comprising a heating coil as the heating element, the heating coil of the piston dosing unit surrounding the piston chamber of the at least one piston dosing unit, each heating element increasing the temperature of the at least one liquid material, wherein a temperature of the first temperature control element can be set in the valve device and a temperature of the second temperature control element can be set in the piston dosing unit and the temperature of the at least one liquid material can be adjusted to a desired temperature by each temperature control unit and each temperature control element.

2. The coating system according to claim 1, wherein each temperature control unit comprises at least one temperature sensor, which is arranged upstream or downstream in the flow path of the temperature control element of a corresponding temperature control unit.

3. The coating system according to claim 1, wherein a third temperature control region is arranged on or in the application device, the third temperature control region having a third temperature control element and a third temperature control unit.

4. The coating system according to claim 3, wherein the application device comprises an outlet end line, on which the third temperature control element of the third temperature control unit is arranged.

5. The coating system according to claim 1, wherein the temperature control element is arranged on a section of a supply line for coating material, said section running through the application device.

6. The coating system according to claim 1, wherein at least one temperature control region is arranged on or in the flow path.

7. The coating system according to claim 1, wherein a) a temperature control region is arranged on or in a supply line between the piston dosing unit and the application device; and/or b) a temperature control region is arranged on or in a feeder line between the piston dosing unit and the material source.

8. The coating system according to claim 1, wherein the application device is connected to a flushing device which feeds flushing agent to the application device via a flushing agent line, wherein a) a temperature control region is arranged on or in the flushing device; and/or b) a temperature control region is arranged on or in the flushing agent line.

9. The coating system according to clam 1, comprising at least two temperature control regions wherein, a first temperature control region has the first temperature control unit having the first temperature control element set to a first temperature and the second temperature control region has the second temperature control unit having the second temperature control element set to a second temperature.

10. The coating system of claim 1 wherein a third temperature control region has a third temperature control unit having a third temperature control element set to a third temperature the third temperature control unit is a heating unit and the third temperature control element is a heating element the heating unit being an inductive heating unit and comprising a heating coil as the heating element, the heating coil surrounding a section of the flow path and/or the application device, so that the at least one liquid material can flow through the heating coil and be heated by the heating coil to third temperature prior to being delivered by the application device.

11. The coating system of claim 1 further comprising a third temperature control unit, the third temperature control unit being located in the flow path between the valve device and the at least one piston dosing unit.

* * * * *